United States Patent [19]

Castellanos

[11] Patent Number: 4,924,444

[45] Date of Patent: May 8, 1990

[54] STIRRING IMPLEMENT

[76] Inventor: Ruben Castellanos, 310 S. Mott St., Los Angeles, Calif. 90033

[21] Appl. No.: 341,851

[22] Filed: Apr. 24, 1989

[51] Int. Cl.[5] ..... B01F 3/00

[52] U.S. Cl. ..... 366/343; 366/129; 366/605

[58] Field of Search ..... 366/129, 343, 349, 605; 15/236.07, 236.08

[56] References Cited

U.S. PATENT DOCUMENTS

| | | | |
|---|---|---|---|
| D. 197,478 | 2/1964 | Larson . | |
| D. 235,307 | 6/1975 | Shoemaker . | |
| D. 256,212 | 8/1980 | Richmond . | |
| D. 268,077 | 3/1983 | Morin . | |
| 1,477,653 | 12/1923 | De La Barre . | |
| 1,498,509 | 6/1924 | Arnold | 366/343 X |
| 1,703,506 | 10/1929 | Hoffer | 366/343 X |
| 1,841,434 | 1/1932 | Gibson | 366/129 |
| 1,969,162 | 8/1934 | Smith | 366/343 X |
| 2,860,858 | 11/1958 | Kurs | 366/129 |
| 3,789,450 | 2/1974 | Mozdenski et al. | 15/236.08 X |

FOREIGN PATENT DOCUMENTS

| | | | |
|---|---|---|---|
| 2167312 | 5/1986 | United Kingdom | 366/343 |

*Primary Examiner*—Frankie L. Stinson
*Attorney, Agent, or Firm*—Jerry T. Kearns

[57] ABSTRACT

A stirring implement designed for use in stirring beverages such as coffee or tea has an elongated shaft connected to a thin flat blade which has parallel side walls connected by radiused corners to a straight bottom edge. The straight bottom edge affords maximum engagement with the bottom surface of a beverage container for maximum stirring efficiency. A hook member may be provided intermediate end portions of the shaft for engagement with a top side wall edge of a beverage container. The stirring blade may be provided with a serrated cutting edge for utility food uses and with a scraping blade for spreading condiments such as jellies or butter upon pastry items.

1 Claim, 2 Drawing Sheets

STIRRING IMPLEMENT

BACKGROUND OF THE INVENTION

1. Field of the Invention

The present invention relates to stirring implements, and more particularly pertains to a stirring implement of the disposable type utilized to stir beverages such as coffee and tea. Sugar, cream and non-dairy toners are frequently added to beverages such as coffee and tea. Currently, very simple stirring implements in the form a flattened straw are utilized to stir these beverages. While these conventional disposable stirring implements are inexpensive, due to their construction, they are inefficient at mixing settled sugar from the bottom of a beverage container with the beverage container liquid contents. Additionally, conventional teaspoons have a pointed tip construction which affords only a minimal contact with the bottom of the beverage container. In order to overcome these problems, the present invention provides a stirring implement which may be inexpensively formed so as to be disposable which has a flat blade construction to afford maximum stirring efficiency.

2. Description of the Prior Art

Various types of stirring implements are known in the prior art. A typical example of such a stirring implement is to be found in U.S. Pat. No. 1,477,653, which issued to C. De La Barre on Dec. 18, 1923. This patent discloses an elongated shaft having a rectangular blade pivotally attached at a distal end thereof. U.S. Pat. No. Des. 197,478, which issued to J. Larson on Feb. 11, 1964, discloses a food stirring implement having an elongated shaft provided with a rectangular stirring blade. U.S. Pat. No. Des. 235,307, which issued to R. Shoemaker on Jun. 10, 1975, discloses a combined spoon and spreading implement having a spoon and a scraping blade provided on opposite ends of an elongated shaft. U.S. Pat. No. Des. 256,212, which issued to E. Richmond on Aug. 5, 1980, discloses a combined spoon and chopper having culinary implements provided at opposite ends of an elongated shaft. U.S. Pat. No. Des. 268,077, which issued to A. Morin on Mar. 1, 1983, discloses a stirring implement having an elongated flat handle formed with an enlarged apertured stirring blade.

While the above mentioned devices are directed to stirring implements, none of these devices disclose a stirring implement which utilizes an elongated shaft having a thin flat blade with parallel side walls connected by radiused corners to a straight bottom edge to afford maximum stirring efficiency. Additional features of the present invention, not contemplated by the aforesaid prior art devices include the provision of a lateral projecting hook for engagement with the top side wall edge of a beverage container and a serrated utility cutting blade along with a transverse arcuately connected spreading blade to form a multi-utilitY stirring implement. Inasmuch as the art is relatively crowded with respect to these various types of stirring implements, it can be appreciated that there is a continuing need for and interest in improvements to such stirring implements, and in this respect, the present invention addresses this need and interest.

SUMMARY OF THE INVENTION

In view of the foregoing disadvantages inherent in the known types of stirring implements now present in the prior art, the present invention provides an improved stirring implement. As such, the general purpose of the present invention, which will be described subsequently in greater detail, is to provide a new and improved stirring implement which has all the advantages of the prior art stirring implements and none of the disadvantages.

To attain this, representative embodiments of the concepts of the present invention are illustrated in the drawings and make use of a stirring implement designed for use in stirring beverages such as coffee or tea having an elongated shaft connected to a thin flat blade which has parallel side walls connected by radiused corners to a straight bottom edge. The straight bottom edge affords maximum engagement with the bottom surface of a beverage container for maximum stirring efficiency. A hook member may be provided intermediate end portions of the shaft for engagement with a top side wall edge of a beverage container. The stirring blade may be provided with a serrated cutting edge for utility food uses and with a scraping blade for spreading condiments such as jellies or butter upon pastry items.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stirring implement which has all the advantages of the prior art stirring implements and none of the disadvantages.

It is another object of the present invention to provide a new and improved stirring implement which may be easily and efficiently manufactured and marketed.

It is a further object of the present invention to provide a new and improved stirring implement which is of a durable and reliable construction.

An even further object of the present invention is to provide a new and improved stirring implement which is susceptible of a low cost of manufacture with regard to both materials and labor, and which accordingly is then susceptible of low prices of sale to the consuming public, thereby making such stirring implements economically available to the buying public.

Still yet another object of the present invention is to provide a new and improved stirring implement which provides in the apparatuses and methods of the prior art some of the advantages thereof, while simultaneously overcoming some of the disadvantages normally associated therewith.

Still another object of the present invention is to provide a new and improved stirring implement constructed to afford maximum stirring efficiency.

Yet another object of the present invention is to provide a new and improved stirring implement having a stirring blade configured to enable settled sugar and other particulate materials to be efficiently stirred from the bottom of a beverage container.

Even still another object of the present invention is to provide a new and improved stirring implement designed as a multi-purpose culinary implement for use in cutting and spreading condiments on pastry items while at the same time serving as an efficient beverage stirring device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
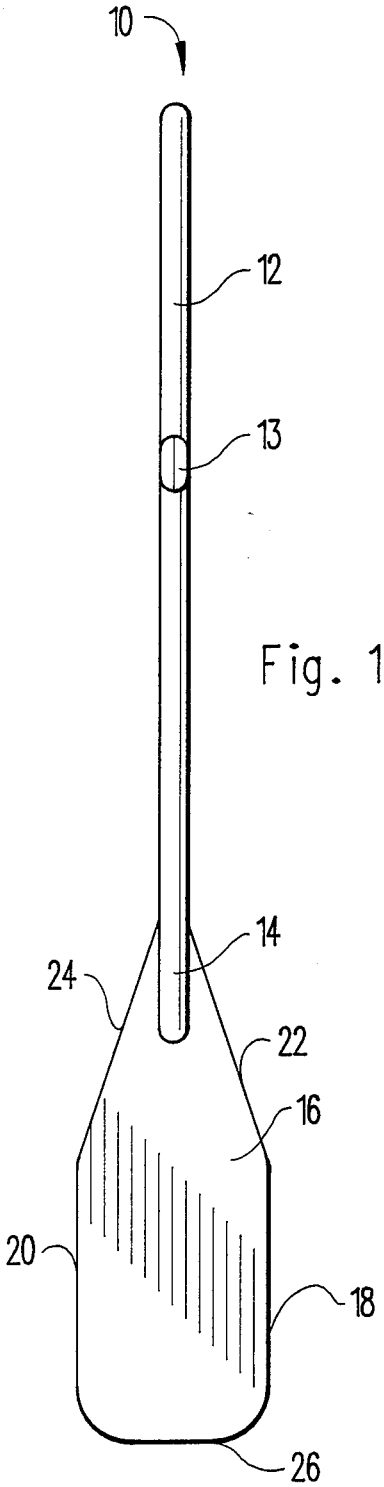
FIG. 1 is a front elevational view illustrating the stirring implement according to the first embodiment of the present invention.

With reference now to the drawings, and in particular to FIG. 1 thereof, a new and improved stirring implement embodying the principles and concepts of the present invention and generally designated by the reference numeral 10 will be described.

More specifically, it will be noted that the first embodiment 10 of the invention includes an elongated cylindrical shaft 12 having a thin flat stirring blade 16 attached at a distal end 14 thereof. A laterally extending hook member 13, for engagement with the top edge of the side wall of a beverage container such as a coffee cup, is formed intermediate the ends of the shaft 12. The blade 16 has parallel side wall portions 18 and 20 connected by radiused corners to a straight bottom edge 26. The parallel side walls 18 and 20 are connected by respective tapering upper side wall portions 22 and 24 to the distal end 14 of the shaft 12.

Figure 2:
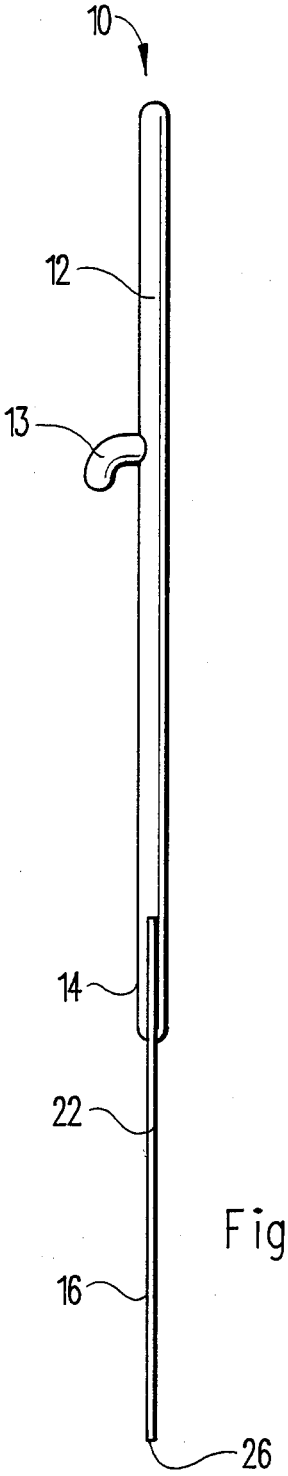
FIG. 2 is a side elevational view further illustrating the stirring implement of FIG. 1.

FIG. 2 is a side view which further illustrates the construction of the hook member 13, which is disposed at a sufficient elevation with respect to the bottom edge 26 of the blade 16 so as to engage the top side wall portion of a standard sized coffee cup when the bottom edge 26 is resting on the interior floor portion of the cup. This allows the implement to be maintained in an unobtrusive location, but ready for immediate use, while the cup contents are consumed. It is contemplated that the stirring implement 10 may be inexpensively formed from a molded plastic material so as to afford disposability after use. The stirring implement 10 may be utilized along with the conventional form of disposable plastic foam cups.

Figure 3:
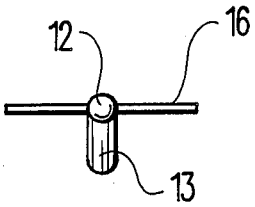
FIG. 3 is a top plan view illustrating the stirring implement of FIG. 1.

FIG. 3 is a top plan view which further illustrates the orientation between the shaft 12, lateral hook 13 and thin flat stirring blade 16.

Figure 4:
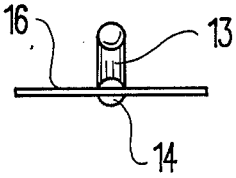
FIG. 4 is a bottom plan view illustrating the stirring implement of FIG. 1.

FIG. 4 is a bottom plan view, which further illustrates the relative orientation of these elements.

Figure 5:
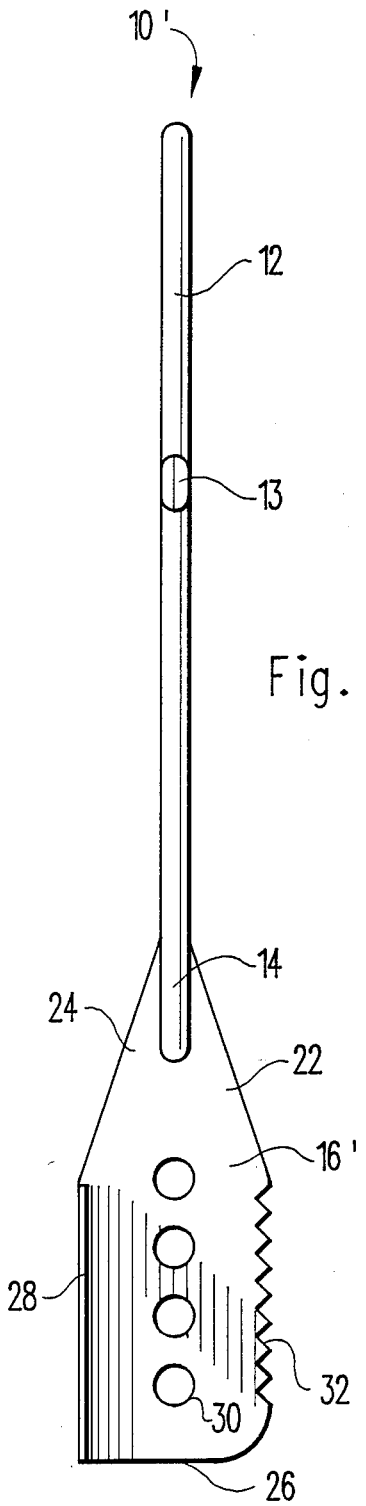
FIG. 5 is a front elevational view illustrating a stirring implement according to a second embodiment of the present invention.

FIG. 5 illustrates a second embodiment 10' of the invention, in which like parts have been referenced utilizing the same reference numerals. The modified stirring blade 16' is provided with a transversely extending scraping blade 28 for use in spreading condiments such as margarine or jelly on pastry items. The opposite parallel side wall portion of the blade 16' is provided with a serrated cutting edge 32 for general utility food usage. A plurality of circular apertures 30 are spaced centrally along the blade 16' to facilitate a turbulent stirring action to further increase the stirring efficiency of the device. It is contemplated that the stirring implement 10' combines a stirring implement along with a multi-purpose culinary utensil into an inexpensive disposable device suitable for use at coffee break facilities where beverages such as coffee and tea are provided along with pastry items.

Figure 6:
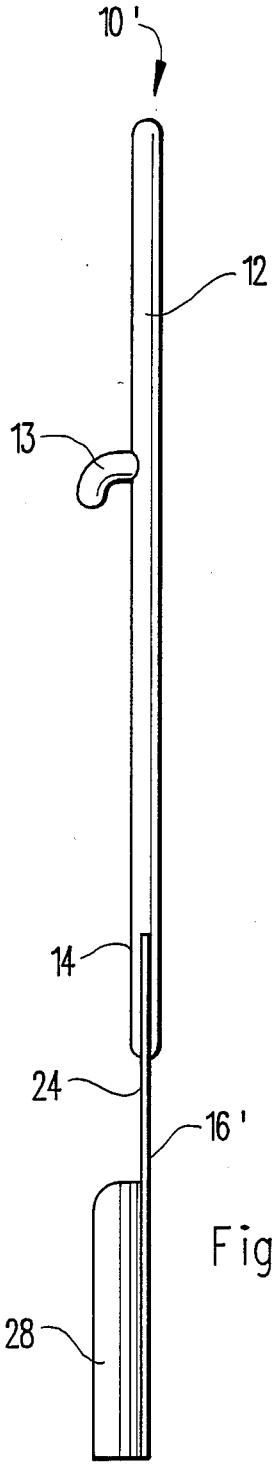
FIG. 6 is a side elevational view of the stirring implement of FIG. 5.

FIG. 6 is a side view which further illustrates the relative orientation between the scraping blade 28 and the stirring blade 16'.

Figure 7:
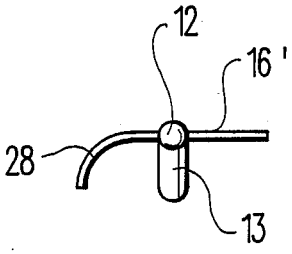
FIG. 7 is a top plan view illustrating the stirring implement of FIG. 5.

FIG. 7 is a top plan view which illustrates the transverse arcuate connection of the scraping blade 28 with the stirring blade 16'. This construction also enables the scraping blade 28 to efficiently remove food materials from cylindrical side wall portions of a storage container.

Figure 8:
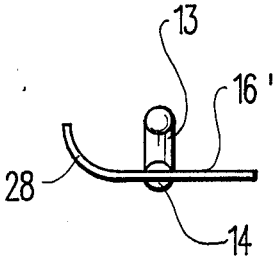
FIG. 8 is a bottom plan view illustrating the stirring implement of FIG. 5.

FIG. 8 is a bottom plan view further illustrating the orientation of the previously described components.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents maY be resorted to, falling within the scope of the invention.

What is claimed as being new and desired to be protected by Letters Patent of the United States is as follows:

1. A stirring implement, comprising:

an elongated cylindrical shaft;

a thin flat blade secured to a distal end portion of said shaft;

said thin flat blade having a pair of generally parallel side walls extending generally parallel to said shaft and connected by radiused corners with a straight bottom transverse edge;

a laterally outwardly extending arcuate downwardly opening hook member disposed intermediate end portions of said shaft and dimensioned for engagement with a top side wall edge of a beverage container;

a scraping blade extending from one of said parallel side walls, said scraping blade perpendicular to said thin flat blade;

said scraping blade connected to said side wall of said thin flat blade by a radiused bend portion;

a serrated cutting edge formed on one of said parallel side walls of said flat blade, opposite said scraping blade; and a plurality of apertures formed through said thin flat blade.

* * * * *